US005484226A

United States Patent [19]

Emerson et al.

[11] Patent Number: 5,484,226

[45] Date of Patent: Jan. 16, 1996

[54] CONTROLLING APPARATUS FOR ASPHALT PAVERS

[75] Inventors: David Emerson; Andrew W. Green, both of Geneva, Ill.

[73] Assignee: Caterpillar Paving Products Inc., Minneapolis, Minn.

[21] Appl. No.: 181,930

[22] Filed: Jan. 18, 1994

[51] Int. Cl.[6] ..... E01C 19/00

[52] U.S. Cl. ..... 404/84.05; 404/108

[58] Field of Search ..... 404/84.05, 84.1, 404/108, 118

[56] References Cited

U.S. PATENT DOCUMENTS

| | | | |
|---|---|---|---|
| 3,537,363 | 11/1970 | Long | 404/108 |
| 3,967,912 | 7/1976 | Parker | 404/84.05 |
| 4,012,160 | 3/1977 | Parker | 404/84 |
| 5,044,819 | 9/1991 | Kilheffer et al. | 404/84.05 |

FOREIGN PATENT DOCUMENTS

| | | | |
|---|---|---|---|
| 0279795 | 1/1988 | European Pat. Off. . | |
| 2029445 | 1/1979 | France . | |
| 4141592 | 6/1993 | Germany . | |
| 278605 | 11/1989 | Japan | 404/84.05 |

*Primary Examiner*—William P. Neuder
*Attorney, Agent, or Firm*—Frank L. Hart

[57] ABSTRACT

The invention is directed to automated controls of an asphalt paver wherein the speed of the conveyor is automatically controlled at a rate proportional and responsive to the speed of the auger and the conveyer is free from having a material sensor and speed control responsive thereto.

13 Claims, 2 Drawing Sheets

CONTROLLING APPARATUS FOR ASPHALT PAVERS

TECHNICAL FIELD

The present invention relates to apparatus for controlling material laydown of asphalt with an asphalt paver.

BACKGROUND ART

Heretofore utilized asphalt pavers have feed conveyors and spreader augers which are mechanically coupled together and driven by single drive motors. They include strike-off gates which are vertically movable and are raised or lowered for the purpose of varying the depth of the asphalt material which is deposited on the feed conveyors to vary the quantity of material which is delivered from the hopper to the region forwardly of the screed.

These heretofore utilized pavers also had first and second separate systems that where substantially identical with substantially identical controlling apparatus. Therefore two "streams" of asphalt were laid down simultaneously and the screed and other apparatus were adapted to blend the two streams together to form a resultant uniform asphalt pathway. The word "asphalt" as used herein means paving material whether it actually contains asphalt (bitumen) or not.

It is therefore desirable to provide controlling apparatus that is highly automated since there are so many adjustments that an operator must make to produce a uniform asphalt pathway. It is also desirable to reduce the number of elements on the machine to as few as possible to prevent waste of materials and labor. This is particularly true of elements which can be replaced by off the shelf elements which are well known and whose reliability has been proven.

An example of heretofore known pavers is described in U.S. Pat. No. 4,012,160 "Paving Machine With Enclosed Material Compartment" which issued on Mar. 15, 1977 to Jimmy L. Parker. This paver has first and second systems for laying down two asphalt streams and each system has a conveyor, a conveyor sensor and an auger and an auger sensor.

In our present invention, each system has only a single sensor. The single sensor is associated with the auger and the conveyor speed is controlled proportionally to the auger speed and said conveyor has no conveyor controlling sensor.

The present invention is also provided with differing separate controlling modules which permit a purchaser to select only those automatic controls which he deems necessary for the types of jobs he generally encounters.

The present invention is directed to overcome one or more of the problems experience in the operation of asphalt pavers.

DISCLOSURE OF THE INVENTION

In one aspect of the invention, material laydown of asphalt with an asphalt paver has a conveyor and a rotatable auger. The auger is adapted to receive asphalt discharging from the conveyor and move and spread the asphalt. A sensor is associated with the auger for sensing the amount of asphalt material adjacent the auger and deliver first and second signals in response to sensed respective excesses and deficiencies of sensed asphalt material. A first hydraulic motor is connected to and driving the auger. A second hydraulic motor is connected to and driving the conveyor. A hydraulic pump is connected to both the auger and the conveyor and adapted to provide pressurized fluid for the operation of said auger and conveyor. A first controlling means is provided for receiving said signals and controlling the speed of said auger in response to said received signals. A second means is provided for controlling the conveyor only in response to the speed of the auger with said conveyor being free of a conveyor sensor.

BEST MODE FOR CARRYING OUT THE INVENTION

In the description of the drawings, one controlling apparatus will be described in detail with reference to FIG. 1 in the interest of brevity. It should be understood that most asphalt pavers will produce two streams of asphalt material and that dual controlling systems that are substantially identical will be utilized and be as shown only in outline in FIG. 2. It should also be understood that various elements of an asphalt paver are very well known in the art and will be shown only diagrammatically in order to simplify study of the drawings and specification.

Figure 1:
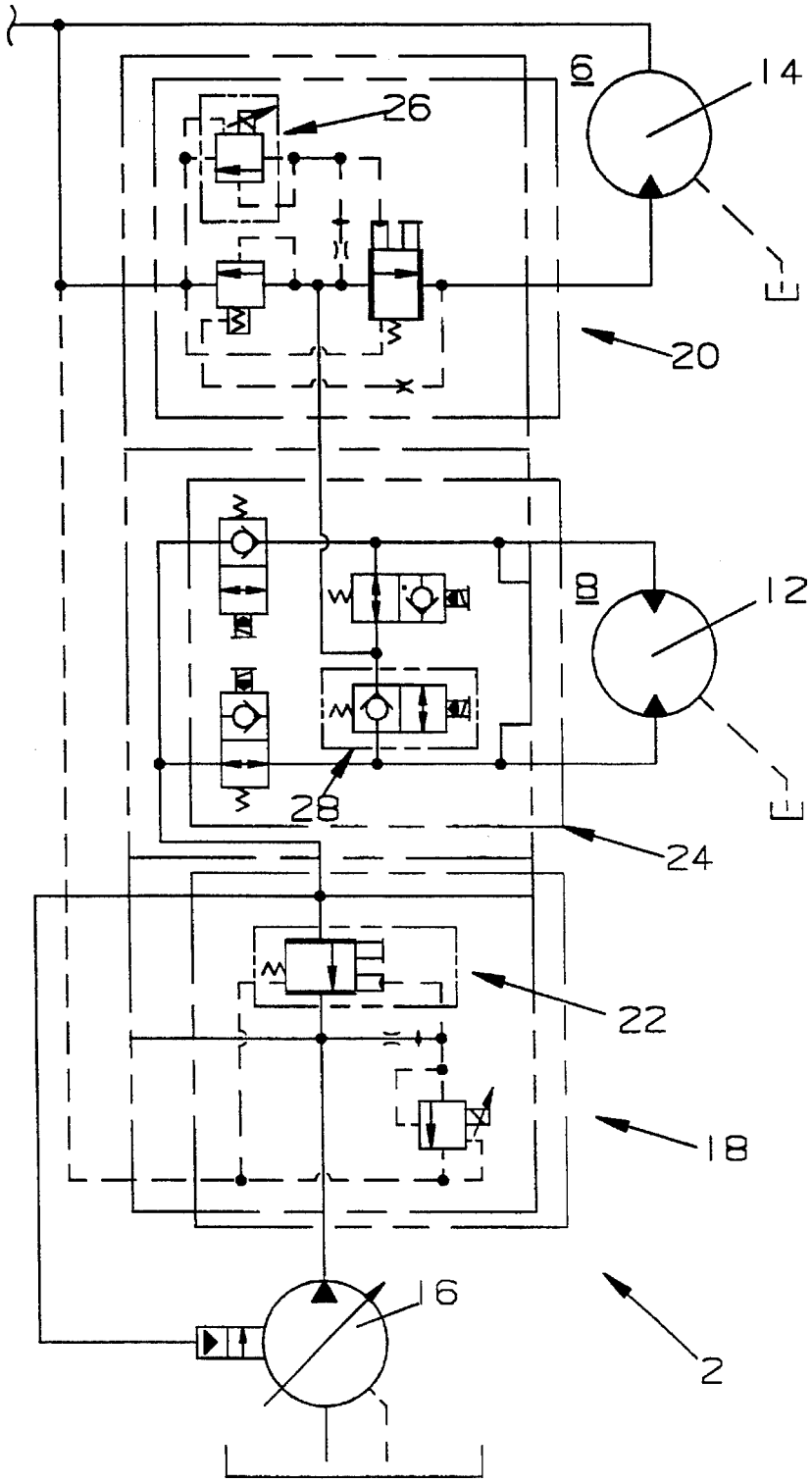
FIG. 1 is a schematic view of the controlling apparatus of this invention.

Referring to FIG. 1, a first controlling system 2 of this invention for an asphalt paver 4 is shown. As is known in the art, the asphalt paver 4 has a conveyer 6, and a rotatable auger 8. The auger 8 is adapted to receive asphalt discharging from the conveyor 6 and move and spread said asphalt. A sensor 10 is associated with the auger 8 for sensing the amount of asphalt material adjacent the auger 8 and delivering first and second signals in response to sensed respective excesses and deficiencies of sensed asphalt material.

A first hydraulic motor 12 is connected to and driving the auger 8. A second hydraulic motor 14 is connected to and driving the conveyor 6.

A hydraulic pump 16 or two or more pumps 16,16' are connected to the auger motor 12 and the conveyor motor 14 and adapted to provide pressurized fluid for the operation of the auger 8 and conveyor 6. A first controlling means 18 is provided for receiving the signals from the asphalt material sensor 10 and controlling the speed of the auger 8 in response to the received signals. A second controlling means 20 is provided for automatically controlling the conveyor 6 only in response to the speed of the auger 8 and said conveyor 6 is free of a conveyor sensor and free from any controlling of the conveyor speed in response to asphalt material amount sensed on said conveyor 6.

The first controlling means 18 includes a set point signal and the speed of the auger 8 is changed in response to the received signals differing from the set point signal by a preselected magnitude. In a preferred embodiment of this invention, a third means 22 is provided for disabling the first means 18 and manually controlling the speed of the auger 8. A fourth means 24 can also be provided for disabling the first means 18 and reversing the normal direction of rotation of the auger 8. Further, a fifth means 26 can be provided for disabling the second means 20 and manually controlling the speed of the conveyor 6.

In the apparatus of this invention as shown in FIG. 1, the auger motor 12 and the conveyor motor 14 are connected in series with the single pump 16. The second controlling means 20, includes a flow bypass valve 28 connected in parallel across the conveyor motor 14. The bypass valve 28 is preferably a variable speed ratio control valve which is well known in the art of automatic valves. The fifth controlling means of this invention includes an operator controlled ON/OFF valve 26 connected across the auger motor 12.

By providing the apparatus of this invention, the feed of material to the auger 8 and relative control of the conveyer 6 only in response to auger speed permits the asphalt paver to be constructed free of controllable variable feeder gates. As mentioned above, by automating the speeds of the auger 8 and conveyor 6, the elimination of the operation of controlling the variable feeder gates simplifies the operation of the paver and reduces the attention that must be given by the operator.

Figure 2:
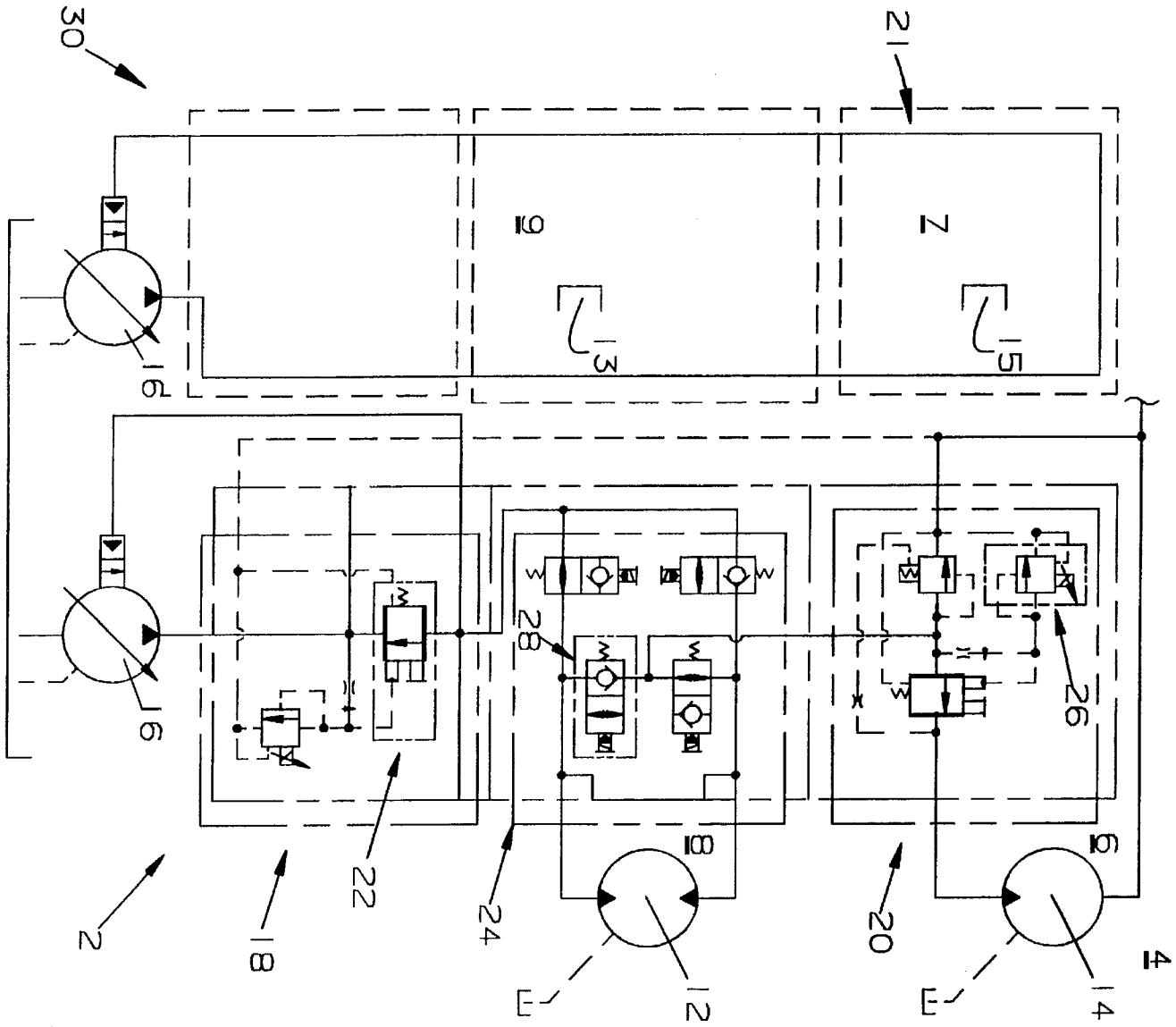
FIG. 2 is a view of two of the controlling apparatus of this invention utilized on an asphalt paver for simultaneously automatically laying two streams of asphalt material with said second system being shown only in outline form.

Referring to FIG. 2, a diagrammatic view is generally shown of the controls of an asphalt paver 4 which has dual separate augers 8,9, conveyors 6,7, auger hydraulic motors 12,13, conveyor hydraulic motors 14,15, first controlling means 18,19, and second controlling means 20,21 defining first and second controlling systems 2,30 which are substantially identical and are powered by fluid from single or multiple hydraulic pumps 16,16'. In this embodiment, the first auger motor 12 and first conveyor motor 14 are connected in series with the pump 16 and the second auger motor 13 and the second conveyor motor 15 are connected in series with pump 16'.

Industrial Applicability

In the operation of the controlling system of this invention, the entire system can be constructed with a plurality of modules and matched to the purchaser's desires. For example, the purchaser could eliminate the reversing function by eliminating the forth means 24 or the manual controlling function of the third means 22. The system can also be operated with a single pump 16 for the motors or a varying number of motors for the dual auger and conveyer motors.

The material feed system consists of a left and right system which are independent and mirror images of each other, as set forth above. The feeder system is electro-hydraulic. Flow from the system pump controls the auger speed and sets the maximum speed for the conveyor. Conveyor speed is also controlled by a flow bypass valve which is plumbed in parallel across the conveyor motor. System pump flow can be bypassed around the conveyor motor, further limiting the conveyor speed with the valve. The ON/OFF valves provide reverse rotation or allow flow bypass around the auger.

The material feed system has two basic operating modes, AUTO and OVERRIDE. In the AUTO mode, a material sensor monitors the amount of asphalt at the end of the screed and proportionally reduces system pump flow and therefore conveyor and auger speed as the amount of material increases. In the OVERRIDE made the system pump and therefore conveyor and auger speed is fixed at a predetermined level. The OVERRIDE mode is typically used for special operating conditions such as preloading material at paver start-up, emptying material at paver clean out, or temporarily adding or decreasing material during paving operations.

The tractor operator can also control the speed ratio between the auger and the conveyer by regulating the hydraulic fluid flow through the bypass valve.

Other aspects, objects and advantages of this invention can be obtained from a study of the drawings, the disclosure and the appended claims.

What is claimed is:

1. In an apparatus for controlling material laydown of asphalt with an asphalt paver having a conveyor and a rotatable auger, said auger being adapted to receive asphalt discharging from the conveyor and move and spread said asphalt, and a sensor associated with the auger for sensing the amount of asphalt material adjacent the auger and delivering first and second signals in response to sensed respective excesses and deficiencies of sensed asphalt material, the improvement comprising:

a first hydraulic motor connected to and driving the auger;

a second hydraulic motor connected to and driving the conveyor;

a hydraulic pump connected to both the auger motor and the conveyor motor and adapted to provide pressurized fluid for the operation of said auger and conveyor, said auger motor and conveyor motor connected in series with the pump;

first controlling means for receiving said signals and controlling the speed of said auger in response to said received signals, said first means includes a set point signal and the speed of the auger is changed in response to the received signals differing from the set point signal by a preselected magnitude; and second means for controlling said conveyor only in response to the speed of said auger and said conveyor being free of a conveyor sensor.

2. An apparatus, as set forth in claim 1, wherein the first means includes a set point signal and the speed of the auger is changed in response to the received signals differing from the set point signal by a preselected magnitude.

3. An apparatus, as set forth in claim 1, including third means for disabling the first means and manually controlling the speed of the auger.

4. An apparatus, as set forth in claim 3, including forth means for reversing the normal direction of rotation of the auger.

5. An apparatus, as set forth in claim 1, including fifth means for disabling the second means and manually controlling the speed of the conveyor.

6. An apparatus, as set forth in claim 1, wherein the asphalt paver includes two separate augers, conveyors, auger hydraulic motors, conveyor hydraulic motors, and first and second controlling means defining first and second separate systems; and at least one hydraulic pump being connected to both augers and both conveyors and adapted to provide pressurized fluid for separate operation of said separate first and second systems.

7. An apparatus, as set forth in claim 6, wherein the first auger motor and first conveyor motor are connected in series with the pump and the second auger motor and second conveyor motor are connected in series with said pump.

8. An apparatus, as set forth in claim 1 wherein the auger motor and the conveyor motor are connected in series with the pump.

9. An apparatus, as set forth in claim 1, including a flow bypass valve connected to the conveyor and connected in parallel across the conveyor motor.

10. An apparatus, as set forth in claim 9, wherein the flow bypass valve is a variable speed ratio control valve.

11. An apparatus, as set forth in claim 10, wherein the asphalt paver is free of variable feeder gates.

12. An apparatus, as set forth in claim 4, wherein the fifth means includes an ON/OFF valve connected across the auger motor.

13. In an apparatus for controlling material laydown of asphalt with an asphalt paver having dual separate augers and conveyors, first and second auger hydraulic motors, first and second conveyor hydraulic motors, first and second controlling means defining first and second controlling systems, and a sensor associated with the augers for sensing the amount of asphalt material adjacent the augers and delivering first and second signals in response to sensed respective excesses and deficiencies of sensed asphalt material, the improvement comprising:

at least one hydraulic pump connected to both auger motors and conveyor motors and adapted to provide pressurized fluid for separate operation of said first and second systems, said first auger motor and first conveyor motor are connected in series with the pump and the second auger motor and second conveyor motor are connected in series with said pump;

first controlling means for receiving said signals and controlling the speed of said augers in response to said received signals, said first means includes a set point signal and the speed of the auger is changed in response to the received signals differing from the set point signal by a preselected magnitude; and second means for controlling said conveyors only in response to the speed of said augers and said conveyors being free of a conveyor sensor.

* * * * *